US005494415A

United States Patent [19]

Morita

[11] Patent Number: 5,494,415

[45] Date of Patent: Feb. 27, 1996

[54] MAGNETICALLY-DRIVEN PUMP

[76] Inventor: Yoshimitsu Morita, 8925 Riverbend Dr., #19, Huntington Beach, Calif. 92647

[21] Appl. No.: 304,727

[22] Filed: Sep. 12, 1994

[51] Int. Cl.[6] ..... F04B 43/09

[52] U.S. Cl. ..... 417/412

[58] Field of Search ..... 417/410.1, 412, 417/322, 505; 604/67, 153

[56] References Cited

U.S. PATENT DOCUMENTS

| | | | |
|---|---|---|---|
| Re. 26,509 | 12/1968 | Walton | 417/412 |
| 2,816,514 | 12/1957 | Freese | 417/412 |
| 3,005,313 | 10/1961 | Carlson | 416/322 |
| 3,171,360 | 3/1965 | Walton | 417/412 |
| 3,518,033 | 6/1970 | Anderson | 417/478 |
| 4,014,318 | 3/1977 | Dockum et al. | 417/412 |
| 4,140,121 | 2/1979 | Kuhl et al. | 604/891.1 |
| 4,140,122 | 2/1979 | Kuhl et al. | 604/890.1 |
| 4,443,216 | 4/1984 | Chappell | 417/412 |
| 4,501,405 | 2/1985 | Usry | 417/412 |
| 4,565,497 | 1/1986 | Miller et al. | 417/412 |
| 5,286,176 | 2/1994 | Bonin | 417/322 |

*Primary Examiner*—Richard A. Bertsch

*Assistant Examiner*—Peter G. Korytnyk

*Attorney, Agent, or Firm*—Nilsson, Wurst & Green

[57] ABSTRACT

A magnetically-driven pump transferring fluid through a conduit is provided, having an electromagnet assembly selectively excited by a power source, and a non-ferromagnetic lever structure extending from the electromagnet assembly to the conduit, the lever structure having a ferro-magnetic portion, which may consist of a plate, at one end movable by the electromagnet assembly between a release position where the ferro-magnetic portion is angularly offset relative to the electromagnet assembly and a compression position where the ferro-magnetic portion is in substantially parallel contact with the electromagnet assembly, the ferro-magnetic portion enabling a striker portion at another end of the lever structure to compress the conduit at a predetermined frequency. The lever structure couples movement of the ferro-magnetic portion at one end with movement of a striker at the other end such that the ferro-magnetic portion moves within a lesser arcuate range and the striker moves within a greater arcuate range. To reduce operating noise, the lever may be pivotally mounted on a translating shaft, enabling a part of the ferro-magnetic portion to remain in contact with the electromagnet assembly while in and between the release and compression positions.

20 Claims, 2 Drawing Sheets

Fig. 2A
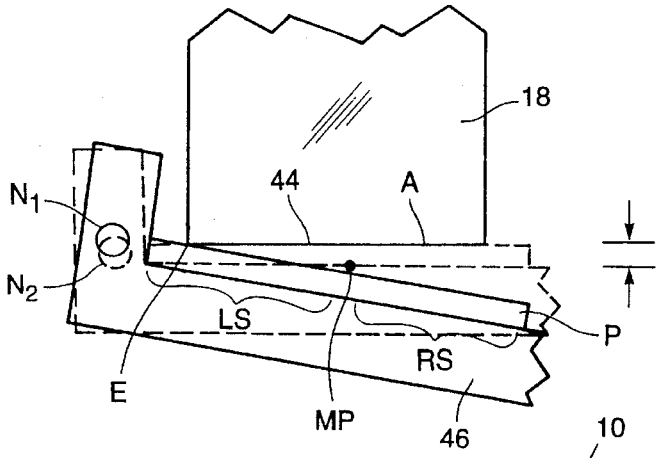
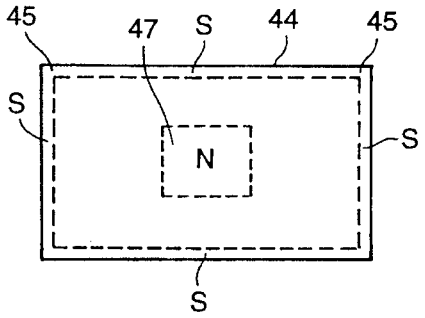
Fig. 2B
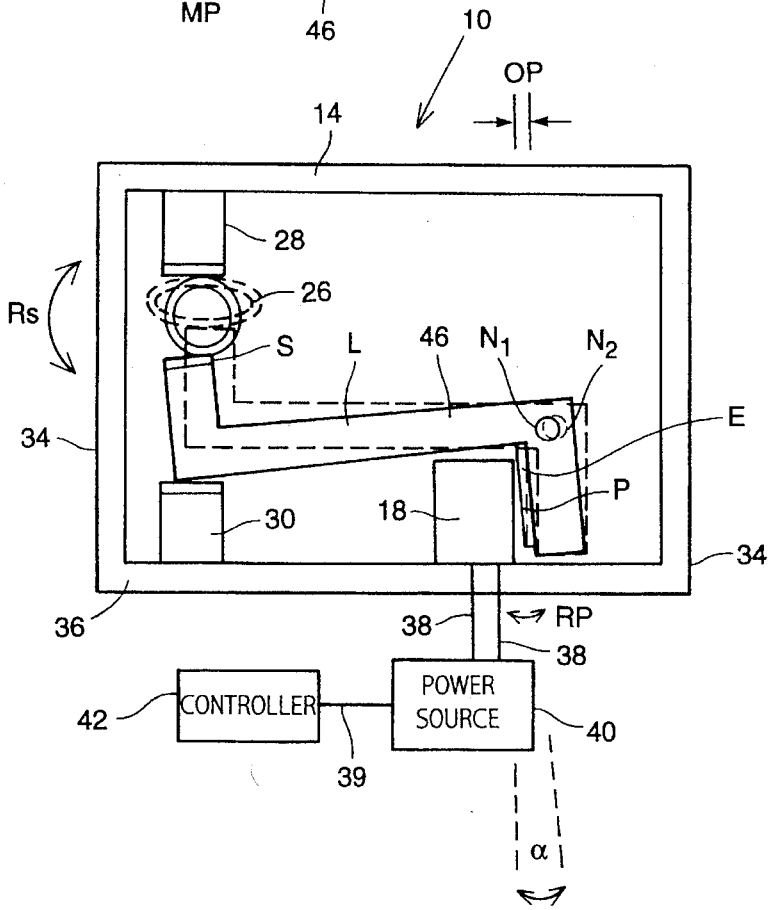
Fig. 3

MAGNETICALLY-DRIVEN PUMP

FIELD OF THE INVENTION

This invention relates generally to pumps, in particular, to magnetically-driven pulsation pumps.

BACKGROUND AND SUMMARY OF THE INVENTION

Pumps delivering relatively small amounts of fluid are known. Such pumps typically employ fluid elements, such as elastic tubes or diaphragms, to draw and deliver fluid at a predetermined rate. These pumps may be magnetically driven, employing bipolar or dipole magnets (magnets having two opposite poles widely spaced at opposing edges or ends) for compressing the diaphragms or tubes. Although such magnets provide relatively extensive magnetic fields, the corresponding magnetic forces are weak. These pumps typically incorporate specially manufactured components and require substantial power to operate. Moreover, they are particularly noisy in operation.

Also known are peristaltic pumps employing rotating disks with protrusions which pinch circumscribing rubber tubes to pump fluid at a rate proportional to the rotation frequency of the disks. Peristaltic pumps are popular in the medical field, especially for intravenous medication or dietary supplements. Although such pumps are relatively quiet, they are also costly and complex in structure. Furthermore, because the tubes are repeatedly exposed to the protrusions on the rotating disk, the tubes must be replaced frequently.

Specific examples of known pumps are discussed, for example, in U.S. Pat. No. 3,171,360, issued to Walton. Therein, a vibration pump is disclosed, having a resilient tubular conduit and a striker reciprocable at a high frequency against one side of the tubular conduit, a support opposite the area of impact of the striker having an engaging face inclined at an acute angle relative to the tubular conduit, and means for reciprocating the striker at high frequency and through a short stroke relative to the diameter of the tubular conduit.

Also, in U.S. Pat. No. 4,014,318, issued to Dockum, et al., a circulatory assist device and structure are disclosed, providing an electrically operated plunger momentarily occluding the blood vessel to effect pumping, wherein a plurality of assist devices may be mounted adjacent each other and are sequentially actuated to occlude adjacent segments of the associated blood vessel, thereby creating a pumping action.

Moreover, a non-sucking pulsatile outflow continuous inflow pump is disclosed in U.S. Pat. No. 3,518,003, issued to Anderson, consisting of a first distensible body forming a chamber which is flat in cross-section when the body is in repose, this first body serving as a ventricle chamber, means forming an inlet and an outlet to the chamber, the inlet interconnecting the ventricle with an atrium comprised of an additional distensible body, and valves and impellers associated with the ventricle and atrium chambers arranged for synchronous operation of the valves and impellers to produce a pulsatile discharge from the ventricle outlet and a continuous unrestricted inflow of liquid to the atrium.

As indicated, these pumps are substantially complex in structure and require special components which increase their cost and maintenance. In particular, where dipole or bi-polar magnets are utilized to supply the necessary magnetic force to drive such pumps, the pumps can become quite expensive.

Accordingly, there exists a demand for a simple and quiet magnetically-driven pump that is relatively inexpensive to manufacture and operate. It is desired that such a magnetically-driven pump use inexpensive, off-the-shelf components, but provide enough force to pump fluid to a substantial height. It is also desired that such a magnetically-driven pump be compact and light. It is further desired that such a magnetically-driven pump be energy-efficient, requiring low voltage and current for operation, and be appropriate for personal use with minimal operating noise.

In accordance with the present invention, a magnetically-driven pump transferring fluid through a conduit is provided, having an electromagnet assembly selectively excited by a power source, and a non-ferromagnetic lever structure extending from the electromagnet assembly to the conduit, the lever structure having a ferro-magnetic portion at one end movable by the electromagnet assembly between a release position where the ferro-magnetic portion is angularly offset relative to the electromagnet assembly and a compression position where the ferro-magnetic portion is in substantially parallel contact with the electromagnet assembly, the ferro-magnetic portion enabling a striker portion at another end of the lever structure to compress the conduit at a predetermined frequency. The lever structure couples movement of the ferro-magnetic portion at one end with movement of a striker at the other end such that the ferro-magnetic portion moves within a lesser arcuate range and the striker moves within a greater arcuate range. To reduce operating noise, the lever may be pivotally mounted on a translating shaft, enabling a part of the ferro-magnetic portion to remain in contact with the electromagnet assembly while in and between the release and compression positions.

These, as well as other features of the invention, will become apparent from the detailed description which follows, considered together with the appended drawings.

DESCRIPTIONS OF THE DRAWINGS

In the drawings, which constitute a part of this specification, exemplary embodiments demonstrating various features of the invention are set forth as follows:

FIG. 2A is an enlarged portion of the magnetically-driven pump of FIG. 2;

FIG. 2B is a schematic representation of the arrangement of magnetic poles on the face of an electromagnet assembly of the embodiment of FIG. 1; and FIG. 3 is a side elevation view of a magnetically-driven pump constructed in accordance with another embodiment of the present invention.

DESCRIPTION OF THE ILLUSTRATIVE EMBODIMENTS

As indicated above, detailed illustrative embodiments are disclosed herein. However, structures for accomplishing the objectives of the present invention may be detailed quite differently from the disclosed embodiments. Consequently, specific structural and functional details disclosed herein are merely representative; yet, in that regard, they are deemed to afford the best embodiments for purposes of disclosure and to provide a basis for the claims herein which define the scope of the present invention.

Figure 1:
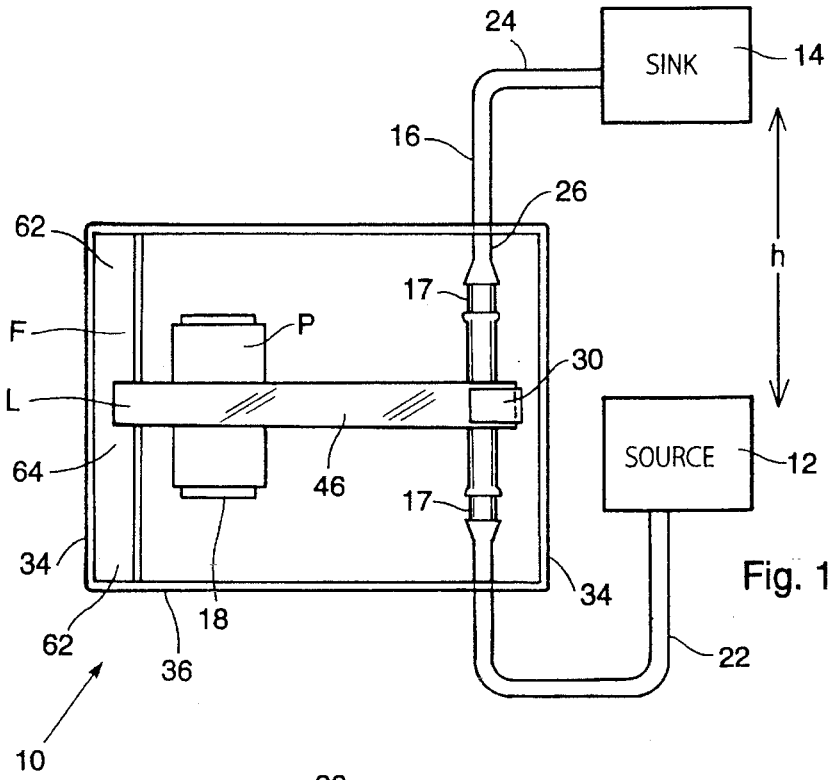
FIG. 1 illustrates a magnetically-driven pump constructed in accordance with a preferred embodiment of the present invention.

FIG. 1 illustrates a preferred embodiment of a pump 10 for transferring fluid from a source 12 to a sink 14. For instance, the sink 14 may be an aquarium into which the pump 10 delivers water or chemicals at a predetermined rate. In accordance with the present invention, the pump provides a tubular conduit 16 through which the fluid travels, and an electromagnet assembly 18 positioned somewhat remotely from the conduit 16 to drive a lever structure L extending from the assembly 18 to the conduit 16. The lever structure L is configured to compress the conduit 16 when the electromagnet assembly 18 is in an excited state, and to release the conduit 16 when the electromagnet assembly 18 is in an unexcited state. Where the conduit 16 is constructed of a material providing a preselected resilience or elasticity, e.g., Neoprene®, the conduit 16 substantially expands or rebounds to its original shape when it is released from compression. Accordingly, the conduit 16 may be alternately compressed and released to pump the fluid from the source 12 to the sink 14. To that end, check valves 17 are provided to regulate the direction of flow in the conduit 16.

The conduit 16 may have an inflow segment 22 extending from the source 12 to the pump 10, an outflow segment 24 extending from the pump 10 to the sink 14, and a center segment 26 therebetween, extending through the pump 10. The center segment 26 is supported in the pump 10 against a conduit abutment 28 opposing a striker abutment 30 (see FIG. 2). A housing 32 has side panels 34 affixed to a base panel 36 and is provided to enclose and support the pump 10.

Figure 2:
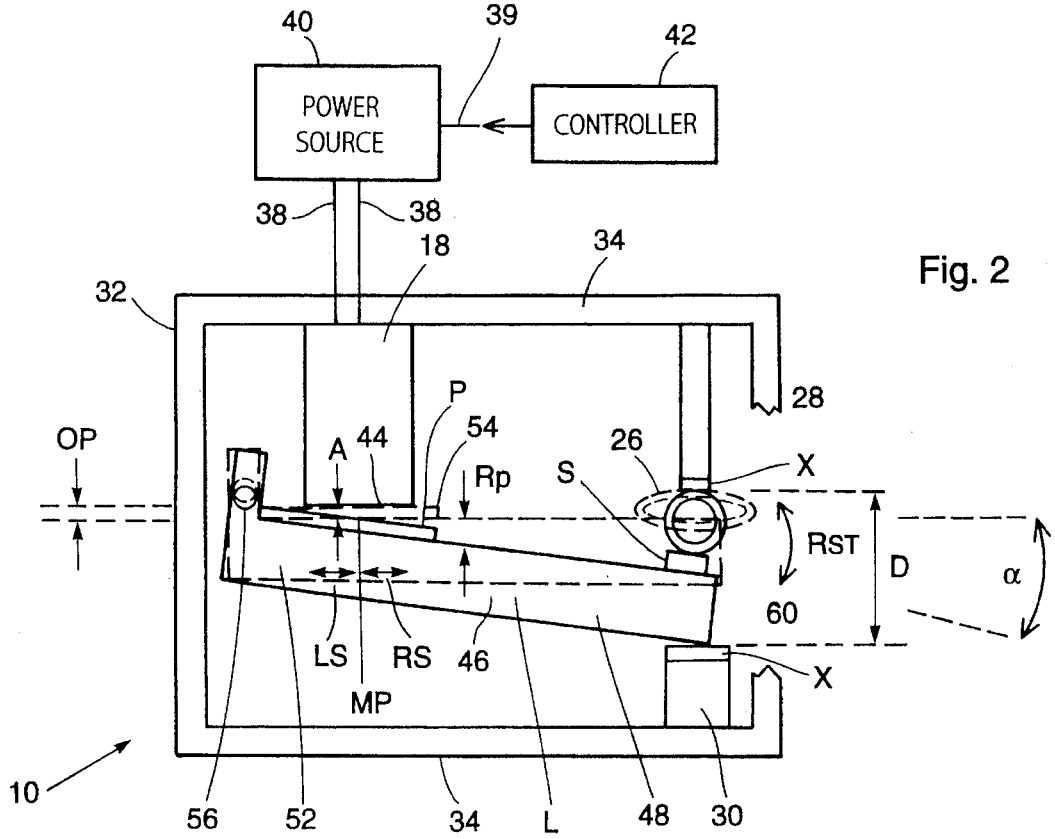
FIG. 2 is a plan view of the magnetically-driven pump of FIG. 1.

As more clearly shown in FIG. 2, the electromagnet assembly 18 is rigidly affixed to one of the side panels 34 of the housing 32. The electromagnet assembly 18 is connected via wires or coils 38 to a power source 40 controlled by a controller 42, e.g., a circuit board, via a wire 39, for driving the electromagnet assembly 18 at a predetermined frequency, which may be relatively low, for instance, less than 100 Hz, ranging between 40 and 60 Hz. Typically, the frequency may be approximately 60 Hz.

The electromagnet assembly 18 may include any readily-available flat-faced electromagnet operable with low voltage and current, e.g., 12 VDC and 0.5 amp., to supply a contact holding power of at least approximately 45 kgs. Being flat-faced and of a substantially rectangular configuration, the electromagnet assembly 18 is relatively simple in design and typically inexpensive. Moreover, by providing a planar surface 44 having a magnetic field with two poles, e.g., south poles, positioned at edges 45 of the planar surface 44, and opposite poles, e.g., north poles, positioned in a center region 47 (see FIG. 2B), the electromagnet assembly 18 provides a magnetic field with a relatively higher flux in the area adjacent the planar surface 44, but with relatively shorter reach than bi-polar or dipole magnets. In that sense, the electromagnet assembly 18 performs extremely well in attracting adjacent planar structures.

The non-ferromagnetic lever structure L includes a bar 46 extending substantially the length of the pump 10, from the electromagnet assembly 18 to the center segment 26 of the conduit 16. An end 48 of the bar 46 adjacent the center segment 26 provides a striker S facing the center segment 26. The other end 52 of the bar 46 adjacent the electromagnet assembly 18 provides a ferro-magnetic portion 54 facing the planar surface 44 of the electromagnetic assembly 18. The ferro-magnetic portion 54 may be a ferro-magnetic plate member P affixed to the bar 46. The lever structure L adjacent the end 52 is pivotally mounted on a shaft F extending between the side panels 34, such that the plate member P may be movable between a release position (solid lines) and a compression position (broken lines).

In the embodiment shown in FIG. 2, the release position involves both the lever structure L and the plate member P being substantially angularly offset from the planar surface 44 of the electromagnet assembly 18. Where the plate member P is in the release position, the striker S substantially releases the center segment 26 from compression and an angle $\alpha$ defined between the plate member P and the electromagnet assembly 18 is at a selected maximum, for example, up to 3.0 degrees, preferably 1.3 degrees for the disclosed embodiments.

Also in the embodiment of FIG. 2, the compression position involves the lever structure L being substantially parallel to the planar surface 44 and the plate member P being substantially in parallel contact with the planar surface 44. Where the plate member P is in the compression position, the striker S substantially compresses the center segment 26 against the conduit abutment 28 and the angle $\alpha$ is at a minimum, for example, zero.

As the plate member P moves between the two positions, a stroke of the pump 10 may be defined as the plate member P moving from the release position to the compression position, and back to the release position. As the lever structure L pivots with the plate member P moving between the two positions, it can be seen that the plate member P moves in a lesser arcuate range $R_P$ while the end 48 bearing the striker S moves in a greater arcuate range $R_{ST}$. By varying the length of the bar 46, different ratios of the greater arcuate range $R_{ST}$ to the lesser arcuate range $R_P$ may be obtained.

In the art of magnetics, an operating proximity may be defined between an object and a magnet as a proximity or distance within which the object and the magnet may be movably attracted to come into contact with each other. As such, there exists an operating proximity OP for the plate member P and the electromagnet assembly 18 of the pump 10. In recognition of this operating proximity OP, it is essential that the lesser arcuate range $R_P$ of the plate member P remains comparable with the operating proximity OP of the pump 10. Otherwise, the electromagnet assembly 18 will be unable to movably attract the plate member P for moving the plate member P into the compression position to pump the fluid. For the disclosed embodiment, where the electromagnet assembly 18 substantially operates on 12 VDC and 0.5 amp, the planar surface 44 being 40 mm×60 mm, and the plate member P being substantially between 3.2 mm and 6.4 mm in thickness, and 50 mm×75 mm, the operating proximity OP of the pump 10 may range up to 3 mm or more, but preferably at 1 mm. To that end, the operating proximity OP of approximately 1 mm enables the disclosed embodiment of the electromagnet assembly 18 to provide an attracting force or power of approximately 2–3 kgs or more.

Because the electromagnet assembly 18 of the present invention operates with minimal voltage and current, the resulting operating proximity OP of the pump 10 is relatively small in comparison to conventional magnetically-drive pumps. While the operating proximity OP may be increased by increasing the power of the electromagnet assembly 18, resulting increases in manufacturing and operating costs undermine the advantages provided by the present electromagnet assembly 18. Notwithstanding the smaller operating proximity OP of the pump 10, the pump 10 provides sufficient compressive force to effectively pump 10 the fluid, as explained below in detail.

With the relatively small operating proximity OP of the pump 10 and thus the lesser arcuate range $R_P$ of the plate member P, the lever structure L necessarily couples the plate member P to the striker S to provide the greater arcuate range $R_{ST}$ in the latter. That is, while the lesser arcuate range $R_P$ should remain comparable to the operating proximity OP of the pump 10, the greater arcuate range $R_{ST}$ should sufficiently accommodate the conduit 16 for compression and release. Since the striker S is provided at the end 48 of the bar 46, the greater arcuate range $R_{ST}$ should enable the striker S to effectively compress and release the center segment 26. Where the conduit 16 has an outer diameter of approximately 13 mm, and inside diameter of approximately 10 mm in diameter, the greater arcuate range $R_{ST}$ should be comparable to 3 mm.

As indicated, a particular ratio of the greater arcuate range $R_{ST}$ to the lesser arcuate range $R_P$ may be provided by selecting the bar 46 to be a particular length. Where the disclosed embodiments set forth the ratio between the greater arcuate range $R_{ST}$ to the lesser arcuate range $R_P$ to be substantially 3 mm:1 mm, the bar 46 should be approximately 12.5 cm in length. As such, the lever structure L may pivot about the shaft F to enable the plate member P to remain substantially in the operating proximity OP and the striker S to effectively compress and release the center segment 26.

At this point, it is noted that although the greater arcuate range $R_{ST}$ of the striker S should sufficiently accommodate the conduit 16, the striker S may be permitted to remain in contact with the center segment 26 throughout the stroke of the pump 10. To that end, the striker abutment 30 is spaced a selected distance D from the conduit abutment 28 for preventing the lever structure L from pivoting beyond the maximum angle $\alpha$ and thus losing contact with the center segment 26. Consequently, the end 48 of the bar 46 remains between the abutments 28 and 30 during the stroke.

Being susceptible to magnetic forces, the plate member P enables the electromagnet assembly 18 to drive the lever structure L. Consequently, where the controller 42 signals the power source 40 to excite the coils 38, the energized electromagnet assembly 18 draws the plate member P into the compression position, pivoting the lever structure L in one direction. With the plate member P being in parallel contact with the electromagnet assembly 18 over substantially the planar surface 44, the lever structure L is positioned for the striker S to compress the center segment 26. The check valves 17 positioned on opposing sides of the center segment 26 regulate flow in the conduit 16 such that the fluid expressed from the center segment 26 as a result of the compression flows toward the outflow segment 24, and ultimately into the sink 14.

Where the coils 38 are in an unexcited state with the electromagnet assembly 18 deenergized, the plate member P is released by the electromagnet assembly 18 to be moved into the release position. With the plate member P being released by the electromagnet assembly 18, the center segment 26 is given the opportunity to elastically rebound from the compression. Consequently, as the center segment 26 expands under its own elasticity, it pushes the striker S toward the striker abutment 30 and the lever structure L pivots in an opposite direction to position the plate member P angularly offset from the planar surface 44. The check valves 17 regulate flow in the conduit 16 such that additional fluid from the source 12 is drawn into the center segment 26 as it rebounds.

For pumping the fluid at the predetermined rate, the plate member P alternates between the compression position and the release position, pivoting the lever about the shaft F and compressing and releasing the center segment 26. As the power source 40 controlled by the controller 42 intermittently excites the coils 38 at a frequency coinciding with the predetermined rate at which the fluid is transferred, the center segment 26 is alternately compressed and released at the excitation frequency.

As indicated earlier, notwithstanding the smaller operating proximity OP of the pump 10, the pump 10 provides sufficient compressive force to effectively transfer the fluid from the source 12 to the sink 14, even where the sink 14 is at a significantly greater height h than the source 12. To that end, the pump 10 applies the nonlinear characteristic of magnetic forces to its advantage for efficiency and economy.

As known in the art, the magnetic force between the electromagnet assembly 18 and the plate member P is nonlinear. That is, the magnetic force increases quadratically as the plate member P approaches the electromagnetic assembly 18, where a relatively significant magnetic force is present when the plate member P is in substantially parallel contact with the electromagnetic assembly 18 over the planar surface 44. In accordance with the present invention, such significant magnetic force applies significant compression in the stroke of the pump 10. This feature enables the pump 10 to transfer the fluid to substantial heights, for instance, at least a height of approximately 3.5 m from the source 12 to the sink 14.

While the elastic force of the conduit 16 opposes the compression during the stroke, it increases only linearly, as opposed to the magnetic force behind the compression which increases quadratically. Consequently, once the plate member P is movably drawn toward the electromagnet assembly 18, the lever structure L is driven with rapidly increasing magnetic force for moving the lever structure L from the release position to the compression position. Although a dramatic increase in magnetic force is necessary to further compress the center segment 26 once its inner surface 60 meets, such further compression is not necessary for the pump 10 to effectively transfer the fluid. The stroke of the pump 10 requires neither absolutely full compression of the conduit 16 nor absolutely full rebound of the conduit 16 to its original shape. Moreover, since the compressive force is applied as pressure on the conduit 16, the smaller the diameter of the conduit 16, the greater the compressive pressure per unit area of the compressed center segment 26.

To summarize the above, the pump 10 minimizes manufacturing and operating costs by being simplistic in structure and design, and utilizing minimal power. Although such minimal power substantially limits the operating proximity OP of the pump 10, the pump 10 employs the lever structure L to couple the respective movements of the plate member P and the striker S such that the lesser arcuate range $R_P$ of the plate member P may be maintained while the greater arcuate range $R_{ST}$ of the striker S is substantially maximized.

As suggested earlier, the release position of the plate member P relative to the planar surface 44 should be substantially comparable to the operating proximity OP for the pump 10 to operate with optimum efficiency. However, the pump 10 actually requires only that an average distance A taken between the electromagnet assembly 18 and the plate member P be substantially comparable to the operating proximity OP. In that respect, the angularly-offset release position of the plate member P does not adversely affect the ability of the electromagnet assembly 18 to draw the plate member P into the compression position, provided that the average distance A is comparable to the operating proximity OP. In fact, such angularly-offset release position facilitates compression of the center segment, as explained in the following example.

For instance, referring to FIG. 2A, by positioning a midpoint MP on the plate member P (in the release position) substantially at the operating proximity OP, a left section LS is significantly closer to the electromagnet assembly 18, while a right section RS is significantly farther from the electromagnet assembly 18. While the average distance A is still comparable to the operating proximity OP, the left section LS experiences an increase in magnetic force which is greater than the decrease in magnetic force experienced by the right section RS. Consequently, a net increase in the magnetic force over the plate member P facilitates the compression of the center segment. In the disclosed embodiment, the angularly-offset release position of the plate member P provides a relatively greater magnetic force than the substantially parallel release position present in typical magnetically-drive pumps. Accordingly, the pump 10 operates efficiently by capitalizing on the particular characteristics of magnetic forces.

Whereas conventional pumps generate substantial noise from components being driven in and out of contact, the pump 10 generates minimal noise. In particular, the lever structure L is positioned relative to the electromagnet assembly 18 such that an edge portion E of the left section LS remains in contact with the electromagnet assembly 18 throughout the stroke. Consequently, as the plate member P moves into the compression position, the edge portion E thereof "pushes against" the electromagnet assembly 18 so that the plate member P is able to come into parallel contact with the electromagnetic assembly 18 over substantially the planar surface 44. When the plate member P moves into the release position, the edge portion E "pushes off" the electromagnet assembly 18 so that the plate member P is able to rest in the angularly-offset position relative to the electromagnet assembly 18. The edge portion E of the plate member P thus remains in contact with the electromagnet assembly 18 to reduce operating noise of the pump 10. And, in addition to reducing noise, the contact between the edge portion E and the electromagnetic assembly 18 also enables the pump 10 to utilize the power of the electromagnet assembly 18 well within the operating proximity OP.

Furthermore, cushioning material, such as foam, and the like, may be provided on various points of contacts X in the pump 10, for example, on the lever structure L, and the abutments 28 and 30, to further reduce operating noise.

For substantially continuous contact between the plate member P and the electromagnet assembly 18, a center segment 64 of the shaft F on which the lever structure L is hinged translates between points $N_1$ and $N_2$. In particular, the center segment 64 translates from point $N_1$ to $N_2$ as the lever structure L moves from the release position to the compression position, and from $N_2$ back to $N_1$ as the lever structure L moves from the compression position back to the release position. To enable the center segment 64 to translate between the points $N_1$ and $N_2$, the shaft F is constructed of a resiliently flexible material, allowing ends 62 of the shaft F to remain fixedly attached to the side panels 34 while the center segment 64 substantially bows as necessary to accommodate movement of the lever structure L.

FIG. 3 illustrates another embodiment of the present invention, where like elements are referenced with similar numerals. In this embodiment, the plate member P is position relatively perpendicular to the bar 46. Notwithstanding, the plate member P still moves between the release position (solid lines) and the compression position (broken lines), with the lever structure L compressing and releasing the center segment 26 with the striker S. Again, the lever structure L couples the lesser arcuate range $R_P$ of the plate member P with the greater arcuate range $R_{ST}$ of the striker S. Also, again, the edge portion E of the plate member P remains in contact with the electromagnet assembly 18 throughout the stroke, the shaft F translating between the points $N_1$ and $N_2$.

It may be seen that the structure of the present invention may be readily incorporated in various embodiments to provide a pump 10. The various components and dimensions disclosed herein are merely exemplary and may not be to scale. Of course, various alternative techniques may be employed departing from those disclosed and suggested herein. For example, the plate member P may be variously joined with the lever structure L, provided that the plate member P moves between the angular-offset release position and the substantially parallel compression position. Also, the lever structure L may be variously configured, provided that it enables the plate member P to move within the lesser arcuate range $R_P$ and the striker S to move within the greater arcuate range $R_{ST}$. Also, the means enabling the pivotal point of the lever structure L to translate may also be varied or assisted, for instance, by various tension members, such as springs or elastic bands.

Consequently, it is to be understood that the scope hereof should be determined in accordance with the claims as set forth below.

What is claimed is:

1. A pump for transferring fluid in a conduit, comprising:

an electromagnet assembly selectively excited by a power source; and a non-ferromagnetic lever structure extending from the electromagnet assembly to the conduit, said lever structure having a ferro-magnetic portion at one end movable by the electromagnet assembly between a release position where said ferro-magnetic portion is angularly offset relative to the electromagnet assembly and a compression position where said ferro-magnetic portion is in substantially parallel contact with the electromagnet assembly, said ferro-magnetic portion enabling a striker portion at another end of the lever structure to compress said conduit when said electromagnet assembly is excited.

2. A pump in accordance with claim 1, wherein said lever structure is pivotable about a point such that said ferro-magnetic portion consisting of a plate is movable within an arcuate range and said striker portion is movable with a greater arcuate range.

3. A pump in accordance with claim 2, wherein said arcuate range is substantially within an operating proximity of said electromagnet assembly relative to said ferro-magnetic portion.

4. A pump in accordance with claim 3, wherein a first section of said ferro-magnetic portion is positioned substantially within said operating proximity and a second section of said ferro-magnetic portion is positioned substantially outside said operating proximity.

5. A pump in accordance with claim 4, wherein a part of said first section of said ferro-magnetic portion remains in contact with said electromagnet assembly throughout a stroke.

6. A pump in accordance with claim 5, wherein said pivotal point of said lever structure translates between two positions for enabling said part to remain in contact with said electromagnet assembly during the stroke.

7. A pump in accordance with claim 3, further comprising means for maintaining said arcuate range of said ferro-magnetic portion to be substantially within said operating proximity.

8. A pump in accordance with claim 2, where said point is positioned such that said electromagnet assembly is substantially between said point and said striker portion.

9. A pump in accordance with claim 2, where said point is positioned substantially at the end of the lever structure, opposing said striker portion.

10. A pump in accordance with claim 1, wherein said lever structure is pivotally mounted on a shaft positioned adjacent to the electromagnet assembly but remote from said conduit.

11. A pump in accordance with claim 1, wherein said lever structure has a selected length for prescribing a predetermined ratio between said arcuate ranges.

12. A pump in accordance with claim 1, wherein said striker portion compresses said conduit at a predetermined frequency not exceeding 60 Hz.

13. A pump in accordance with claim 1, wherein said conduit provides a selected elasticity for repelling said striker portion to move the ferro-magnetic portion into said release position.

14. A pump in accordance with claim 13, further comprising a first abutment positioned adjacent the conduit to substantially oppose the striker.

15. A pump in accordance with claim 14, further comprising a second abutment positioned a selected distance from said first abutment such that said conduit is positioned substantially between said abutments.

16. A pump in accordance with claim 1, where said electromagnet assembly operates with substantially six or less watts.

17. A pump for transferring fluid in a tubular conduit from a source to a sink, comprising:

an electromagnet assembly excited at a predetermined frequency, said electromagnet assembly providing a planar surface;

a non-ferromagnetic lever structure extending from the electromagnet assembly to the conduit, said lever structure having a ferro-magnetic plate member adjacent one end, said ferro-magnetic plate member facing said planar surface of said electromagnet assembly and being movable by the electromagnet assembly between a release position where said ferro-magnetic plate member is angularly offset relative to the electromagnet assembly and a compression position where said ferro-magnetic plate member is in contact with the electromagnet assembly substantially over the planar surface, said lever structure providing a striker portion at another end to compress said conduit when said electromagnet assembly is excited.

18. A pump in accordance with claim 17, wherein said lever structure pivots about a point such that said one end with the ferro-magnetic plate member moves within a lesser arcuate range substantially within an operating proximity of said pump, and said other end with said striker portion moves within a greater arcuate range.

19. A pump in accordance with claim 17, wherein a part of said ferro-magnetic plate member remains in contact with said electromagnet assembly whether said ferro-magnetic plate member is in said release position or said compression position.

20. A pump in accordance with claim 17, where said electromagnet assembly operates with substantially six or less watts.

* * * * *